US005279897A

United States Patent [19]

Goodall et al.

[11] Patent Number: 5,279,897

[45] Date of Patent: Jan. 18, 1994

[54] CARPET YARN HAVING HOLLOW FILAMENT CROSS-SECTIONS CONTAINING FOUR CONTINUOUS VOIDS

[75] Inventors: Michael T. Goodall, Landenberg, Pa.; Craig A. Jackson; Perry H. Lin, both of Seaford, Del.

[73] Assignee: E. I. Du Pont de Nemours and Company, Wilmington, Del.

[21] Appl. No.: 969,323

[22] Filed: Oct. 30, 1992

Related U.S. Application Data

[62] Division of Ser. No. 735,241, Jul. 24, 1991, Pat. No. 5,190,821.

[51] Int. Cl.[5] ..... D02G 3/00

[52] U.S. Cl. ..... 428/398; 428/376; 428/397; 428/92; 428/97

[58] Field of Search ..... 428/376, 397, 398, 92, 428/97

[56] References Cited

U.S. PATENT DOCUMENTS

| | | | |
|---|---|---|---|
| 3,745,061 | 7/1973 | Champaneria | 428/398 |
| 4,020,229 | 4/1977 | Cox | 428/398 |
| 4,836,763 | 6/1989 | Broaddus | 425/131.5 |
| 5,190,821 | 3/1993 | Goodall et al. | 428/398 |

FOREIGN PATENT DOCUMENTS

| | | |
|---|---|---|
| 9084072 | 7/1971 | Fed. Rep. of Germany . |
| 30111183 | 10/1981 | Fed. Rep. of Germany . |

*Primary Examiner*—Patrick J. Ryan
*Assistant Examiner*—N. Edwards

[57] ABSTRACT

A carpet yarn containing continuous synthetic filaments having a four sided cross-sectional contour and four substantially equispaced continuous voids are disclosed. The voids have a substantially round or nonround shape, and each void is substantially centered on a side of the filament's contour.

6 Claims, 8 Drawing Sheets

CARPET YARN HAVING HOLLOW FILAMENT CROSS-SECTIONS CONTAINING FOUR CONTINUOUS VOIDS

This is a division of application Ser. No. 07/735,241, filed Jul. 24, 1991, now U.S. Pat. No. 5,190,821.

BACKGROUND OF THE INVENTION

1. Field of the Invention

The present invention relates to continuous synthetic filaments having a four sided cross-sectional shape containing four continuous voids positioned at distinct locations. The filaments are especially suitable for making carpets which demonstrate improved soiling performance and durability.

2. Description of the Related Art

Those skilled in the art have proposed many different ways to improve the "soiling performance" of continuous synthetic filaments. By the term "soiling performance", it is meant the apparent resistance of a textile material to visible soiling which may be independent of the soiling which actually occurs.

One effort involves producing filaments having continuous voids extending throughout their lengths. As described by Champaneria et al., U.S. Pat. No. 3,745,061, it is known to produce filaments having at least three continuous nonround voids. These voids form about 10% to about 35% of the filament volume and are set against the corners of the filament's cross-sectional contour which is substantially free of re-entrant curves.

W. Lochelfeld et al., German Patent No. DL 90,840/'72 teaches a process for spinning filaments having four hollow spaces. These filaments have high stability due to an approximately circular cross-section. However, the circular cross-section also tends to decrease the bulk of these filaments.

Although such conventional filaments, as described above, have a somewhat effective soiling performance, there is a need for filaments having even greater soiling performance which also demonstrate high bulk and durability. The filaments of the present invention provide an improved combination of soiling performance, bulk, and durability and are especially suitable for carpets receiving a high amount of traffic.

SUMMARY OF THE INVENTION

The present invention relates to continuous filaments, comprising a thermoplastic synthetic polymer and characterized by a solid axial core and four substantially equispaced voids, a void content of about 6% to 25%, and a four-sided cross-sectional contour which is free of substantial convex or concave curves. The voids have a substantially round or nonround shape and each void is substantially centered on a side of the contour. Preferably, the shape of the voids is triangular-like, wherein the apex of each void is directed at the central longitudinal axis of the core, and the base of each void is substantially centered on a side of the contour.

The configurations of the voids may be substantially equidimensional. Suitable polymers include polyolefins such as polypropylene, polyamides such as nylon 66 and nylon 6, and polyesters such as polyethylene terephthalate. Carpet yarns may be made from the filaments of this invention and tufted into backings to form carpets demonstrating improved soiling performance.

The invention also includes spinnerets for producing these filaments. The spinneret comprises a plate having upper and lower surfaces connected by a four-sided, slotted capillary. In one embodiment, the slots define four substantially equispaced round segments, wherein each segment is substantially centered on a side of the capillary. In another embodiment, the slots define four substantially equispaced non-round segments, wherein each segment is substantially centered on a side of the capillary. Preferably, there are four substantially equispaced triangular-like segments, wherein the apex of each segment is directed at the central longitudinal axis of the capillary and the base of each segment is substantially centered on a side of the capillary.

DESCRIPTION OF THE FIGURES

FIG. 1-A is a cross-sectional view taken from photomicrographs of polypropylene filaments spun through capillaries of the type shown in FIG. 1.

FIG. 2-A is a cross-sectional view taken from photomicrographs of polypropylene filaments spun through capillaries of the type shown in FIG. 2

DETAILED DESCRIPTION OF THE INVENTION

The filaments of this invention are generally prepared by spinning molten polymer through spinneret capillaries which are designed to provide the desired configuration of the voids and overall cross-section of the filament.

The filaments may be prepared from synthetic, thermoplastic polymers which are melt-spinnable. These polymers include, for example, polyolefins such as polypropylene, polyamides such as nylon 66 and nylon 6, and polyesters such as polyethylene terephthalate. Both copolymers and melt blends of such polymers are also suitable.

Generally, in the melt spinning process, the molten polymer is extruded into air or other gas, or into a suitable liquid, where it is cooled and solidified. Suitable quenching gasses and liquids include, for example air at room temperature and chilled air. It is recognized that the specific spinning conditions may vary depending upon the polymer used and the desired properties for the filament.

For example, the filament's percentage of voids (void content) may normally be increased by increasing the quenching rate and/or the polymer melt viscosity. In this invention, the filaments have a void content of about 6% to 25% and preferably between about 8% to 25%. It was found that soiling performance increases gradually from about 6% to 25% void content with substantially no improvement in soiling performance occurring between about 25% and 35% void content. At a void content higher than about 35%, the filaments are weakened. The polymer spinning dopes may also contain conventional additives, such as antioxidants, dyes, delustering agents, antistatic agents, etc.

Figure 2:
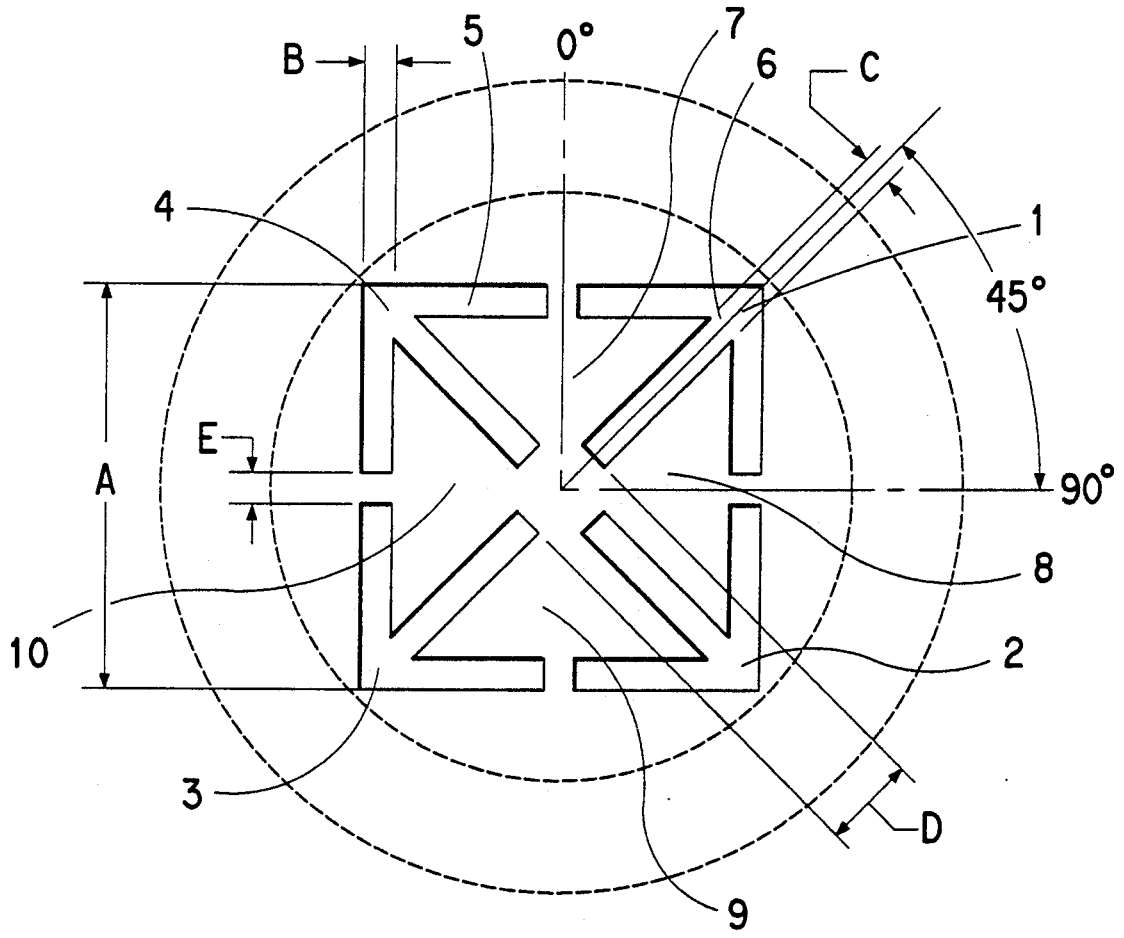
FIG. 2 is a face view of a spinneret capillary suitable for spinning filaments of this invention.
Figure 2A:
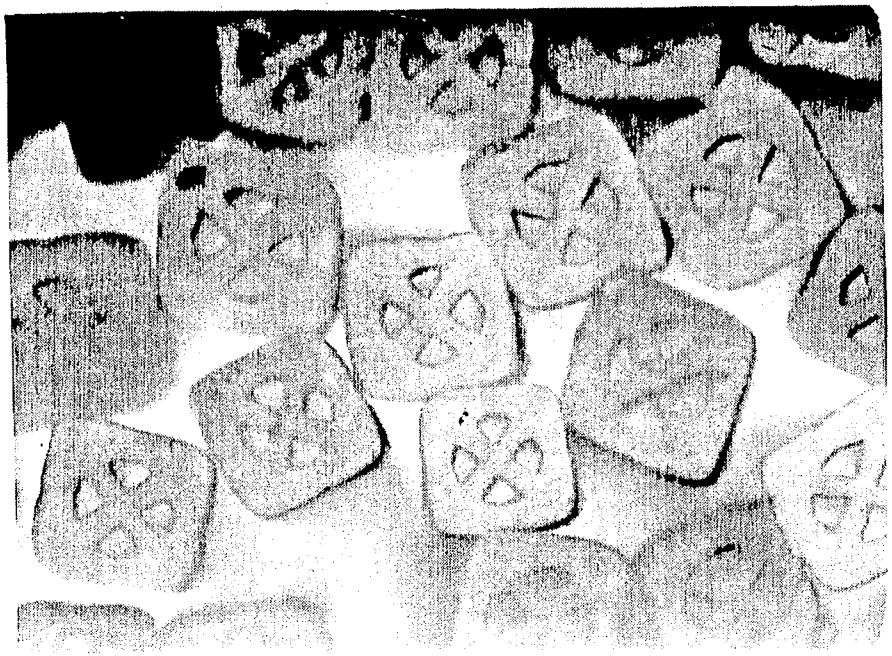

Referring to FIG. 2, a suitable segmented spinneret capillary for forming the filaments of this invention is illustrated.

The four-sided capillary includes four slot units (1), (2) (3) and (4) each comprising of peripheral (5) and radial (6) spokes through which the polymer flows. Between the slots, there are four substantially equispaced segments (7), (8), (9), and (10), through which none of the polymer flows. These segments define the shape and size of the voids in the resulting filaments. The segments may have various nonround shapes to form corresponding nonround voids in the filaments. Alternatively, the segments may have round shapes to form corresponding round voids in the filaments. Preferably, there are four substantially equispaced triangular-like segments. The apex of each triangular-like segment is directed at the central longitudinal axis of the capillary, and the base of each segment is substantially centered on a side of the capillary.

A typical capillary has an outside diameter (A) of 0.0791 inches, peripheral spokes (5) having a width (B) of 0.0080 inches, and radial spokes (6) having a width (C) of 0.0065 inches. The spacing (D) between the ends of the radial spokes is typically 0.0100 inches, while the spacing (E) between the ends of the peripheral spokes is 0.0079 inches. The depth of the capillary is 0.035 inches, and the length to diameter (L/D) ratio (0.035/0.0065) is about 5.4. It is understood that the above dimensions may vary, depending upon the melt viscosity and surface tension of the specific polymer.

It is critical that the segments be arranged in order that the four voids of the resulting filaments are oriented away from the corners and aligned with the sides of the filament's cross-sectional contour. The segments are positioned such that each void is substantially centered on a side of the cross-section, as shown in FIG. 2-A. The filaments are further characterized by a solid axial core, and the voids are continuous, substantially equispaced, and preferably equidimensional. It is recognized that filaments having voids in their axial cores would also demonstrate effective soiling performance, although the durability of such filaments may be inferior to filaments having a solid axial core. Furthermore, regardless of void shape, it is believed that maximum soiling performance occurs when the largest dimension of the void is positioned at the sides, near the edges, of the filament.

In a preferred configuration, the segments are arranged to form a filament having triangular-like voids, wherein the apex of each void is directed at the central longitudinal axis of the core, and the base of each void is substantially centered on a side of the filament's cross-sectional contour, as shown in FIG. 2-A.

It is also important that the filament's cross-sectional contour be free of substantial convex or concave curves. If the filament's periphery has substantial convex curves, the filament's overall cross-section is substantially circular and bulk is adversely effected. Conversely, if the filament's periphery has substantial concave curves, areas are created which tend to collect soil and reduce soiling performance.

The key improvement demonstrated by the filaments of this invention is their greater soiling performance. Furthermore, the filaments have greater durability, while retaining such properties as bulk, luster and carpet covering power.

The filaments of this invention are especially suitable for producing commercial and residential carpets, particularly level loop pile carpets. The filaments may be used to form yarns which are subjected to texturing and subsequently tufted into a carpet backing material by techniques known in the art. A preferred texturing process involves a hot air jet-bulking method as described in Breen and Lauterbach, U.S. Pat. No. 3,186,155.

TESTING METHODS

Percent Void Determination

The percent void of the filament's cross-section (void content) was measured using a Du Pont Shape Analyzer Model VSA-1, which measured the area of the voids and the area of the filament's entire cross-section. The Du Pont Shape Analyzer characterizes textile fiber yarn cross-sections by performing numerical analysis on the digital contour of individual filament cross-sections. A simple calculation of dividing the void area by the cross-section area provides the % void of the filament's cross-section.

Carpet Soiling Performance

Soiling performance tests of commercial level loop and residential Berber level loop carpets composed of the filaments of this invention were conducted. The tests involved exposing the carpets to a significant amount of soil by an actual foot traffic test. Typical foot traffic levels ranged from 150,000 to 1,000,000, at a rate of about 60,000 to 80,000 traffics per week. The foot traffic was counted by a pressure sensitive pad located under the carpet and attached to an electronic counter. The counter registered traffic when the carpet was stepped on by individuals traveling through a corridor.

The dimensions of the carpet samples can vary. The width of the carpet sample is typically about six (6) feet in order to cover the width of the corridor. The length of the carpet is typically in the range of about six (6) to thirty (30) inches, depending upon the available number of samples. In this instance, the commercial level loop carpet measured fifteen (15) inches x six (6) feet, and the residential Berber carpet measured thirty (30) inches by six (6) feet. The carpets were vacuumed on a nightly basis, regardless of the exact amount of foot traffics.

On a weekly basis, reflectance measurements were made on the different carpet samples using a Minolta Chroma Meter CR-100 measuring device. The CR-100 is a compact tristimulus color analyzer for measuring reflected subject color. Color readings are taken at five (5) different areas on the carpet sample. The Chroma Meter calculates a ΔE, color difference, for each reading.

ΔE color deviation represents total color difference. The equation assumes that color space is Euclides (three-dimensional) and calculates ΔE as the square root of the sum of the squares of the three components representing the difference between coordinates of the sample and the standard, as shown by the equation below:

$$\Delta E = [(\Delta L^*)^2 + (\Delta a^*)^2 + \Delta b^*)^2]^{\frac{1}{2}}$$

where L* is a brightness variable, and a* and b* are chromaticity coordinates. When conducting a soiling performance comparison test, it is important to test all of the samples at the same time and try to maintain the same floor location. Walk off mats are also used to prevent carpet samples closest to the corridor entrance from receiving an unduly amount of traffics. This prevent bias in the testing. The carpet samples in this test were solution dyed during the extrusion process. All samples had virtually the same amount of draw finish. The samples were not exposed to any kind of water treatment (dyeing, scouring, etc.) before testing.

Filament Cross-Section Model

In order to measure the improvement in soiling performance of the filament of this invention, a model was built to represent different filament cross-sections. The objective of this model was to measure soiling performance in a quantitative manner. In order to perform this analysis, the model was constructed using a solid clear plastic square block measuring two (2) inches x two (2) inches. Each half of the solid block was then drilled with four (4) circular holes (voids) to form a block having a cumulative total hole (void) content of 11%.

In one half of the block, the holes were drilled in such a manner that each hole was positioned at a corner of the block. This configuration represented conventional filaments, wherein, the voids are aligned with corners of the filament's cross-section.

In the remaining half of the block, the holes were drilled in such a manner that each hole was aligned with a side of the block. This configuration represented the filaments of this invention, wherein each void is substantially centered on a side of the filament's cross-section.

Measurements were then taken at four (4) different viewing angles along the outside surface of the block to determine the soiling performance of each representative cross-section model. The first measurement was on the flat side (reference 0° angle) and then at 15° intervals up to 45°, which was the corner of the cross-section. Any measurements past the 45° point were mirror images of the original 4 points and repeated themselves around the surface. The measurements were recorded as the percentage of soiling performance at each viewing angle. The soiling performance was calculated by measuring the sum of the widths of the bands of visual distortion across the total width of the block and dividing it by the total width of the block. Whereby, the total width of the block changed at each viewing angle, i.e., at 0°, the total width was the actual width of the block (2 inches). At 45°, the total width was the length of the diagonal across the cube's face (2.8 inches). The formula is as follows:

$$\text{Soiling Performance} = \frac{WD\ (\text{inches})}{WB\ (\text{inches})} \times 100$$

where WD is the width of visual distortion and WB is the total width of the block.

Relative Viscosity

Relative Viscosity (RV) of nylon 66 is the ratio of the absolute viscosity of a solution of 8.4 weight percent nylon 66 (dry weight basis) dissolved in formic acid solution (90% formic acid and 10% water) to the absolute viscosity of the formic acid solution, both absolute viscosities being measured at 25° C. Prior to weighing. the polymer samples are conditioned for two hours in air of 50% relative humidity.

Relative Viscosity of polyethylene terephthalate measured in hexafluoroisopropanol (HRV) is the ratio of a solution of 4.75 weight percent polyethylene terephthalate (dry weight basis) dissolved in hexafluoroisopropanol to the absolute viscosity of hexafluoroisopropanol, both absolute viscosities being measured at 25° C.

The foregoing testing methods were used in the following examples. These examples illustrate the present invention but should not be construed as limiting the scope of the invention.

EXAMPLES

Example 1

In this Example, polypropylene filaments having different cross-sections were prepared.

Sample A

Polypropylene filaments having cross-sections, as shown in FIG. 2-A, were made by the following method.

A melt-spinning dope containing 10.8% MFI (Melt Flow Index) polypropylene polymer was prepared by melting the polymer at 260° C. and cofeeding it with about a 3% light beige color concentrate in a screw extruder. The melt-spinning dope was then spun at 4.1 grams/minute/hole through a spinneret having the configuration shown in FIG. 2. Referring to FIG. 2, the outside diameter (A) of the spinneret capillary was 0.0791 inches. The width (B) of the peripheral spokes (5) was 0.0080 inches, while the width (C) of the radial spokes (6) was 0.0065 inches. The spacing (D) between the ends of the radial spokes was 0.0100 inches, while the spacing (E) between the ends of the peripheral spokes was 0.0079 inches. The depth of the capillary was 0.035 inches, and the length to diameter (L/D) ratio (0.035/0.0065) was about 5.4.

Figure 3:
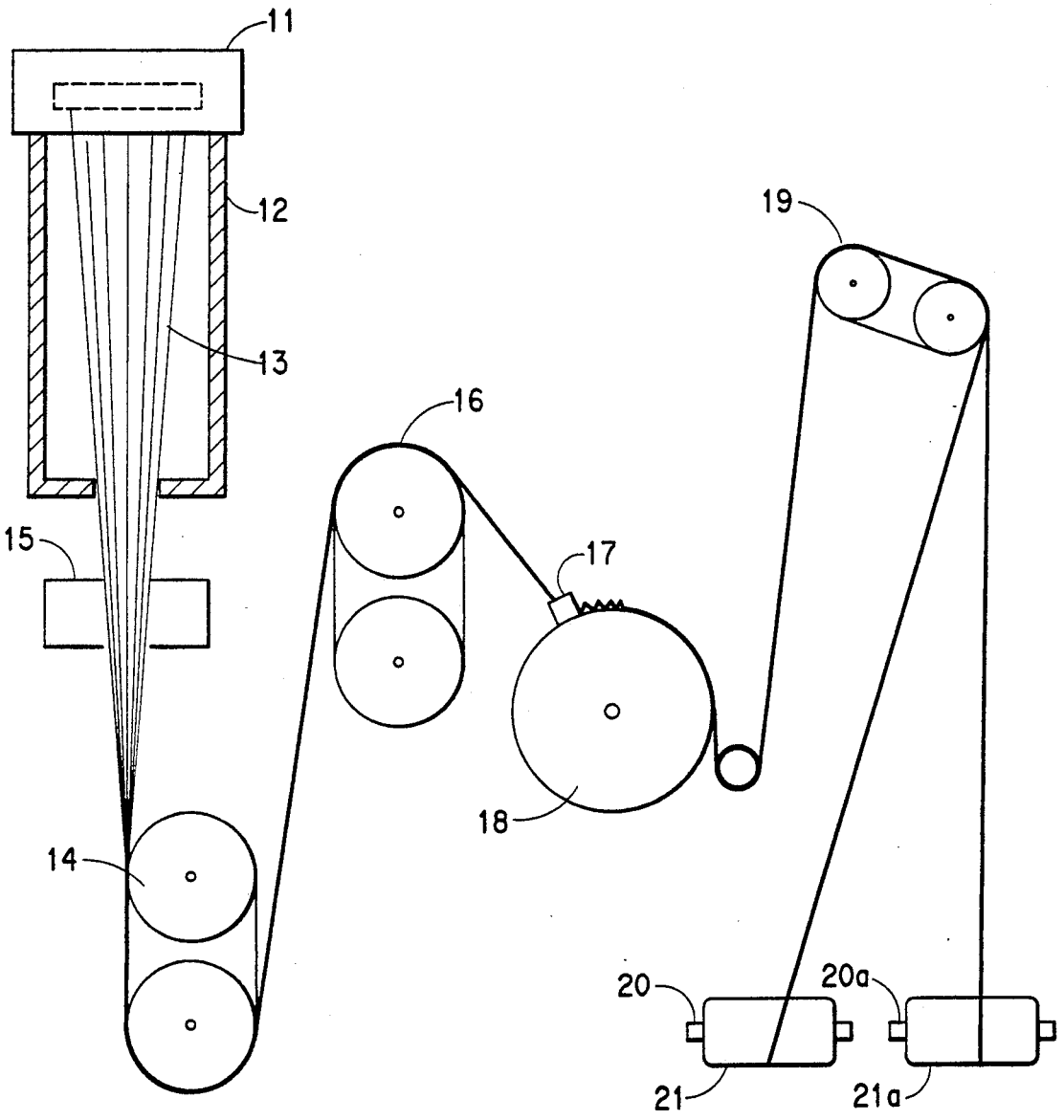
FIG. 3 is a schematic diagram illustrating a process for producing filaments of this invention.

Referring to FIG. 3, the filaments passed from the spinneret (11) into a quenching chimney (12) at a rate of 120 filaments per end, where a cooling gas was blown past the hot filaments (13) at about 1.3 ft./sec. velocity. The filaments were pulled from the spinneret (11) and through the quenching zone by means of a puller or feed roll (14), rotating at 815 yards per minute (ypm). After quenching in air at a temperature of about 15° C., the filaments were treated with aqueous liquid (a mixture of water and non-aqueous draw-finish material) by contacting a finish applicator (15). Next, the filaments passed across the heated (65° C.) feed roll (14) to heated (135° C.) draw rolls (16), rotating at 2656 ypm. Following drawing, the heated filaments were crimped by a hot air, jet-bulking process (17) of the type described in Breen and Lauterbach, U.S. Pat. No. 3,186,155. The bulking air temperature was 165° C. The hot fluid exhausted with the threadlines against a rotating drum (18) having a perforated surface, on which the yarns were cooled to set the crimp. From the drum (18), the threadlines in bulky form passed to a pair of driven take-up rolls (19) onto rotating cores (20) and (20*a*) to form packages (21) and (21*a*). The percent void of the filaments was about 13%.

Comparative Sample B

Figure 1:
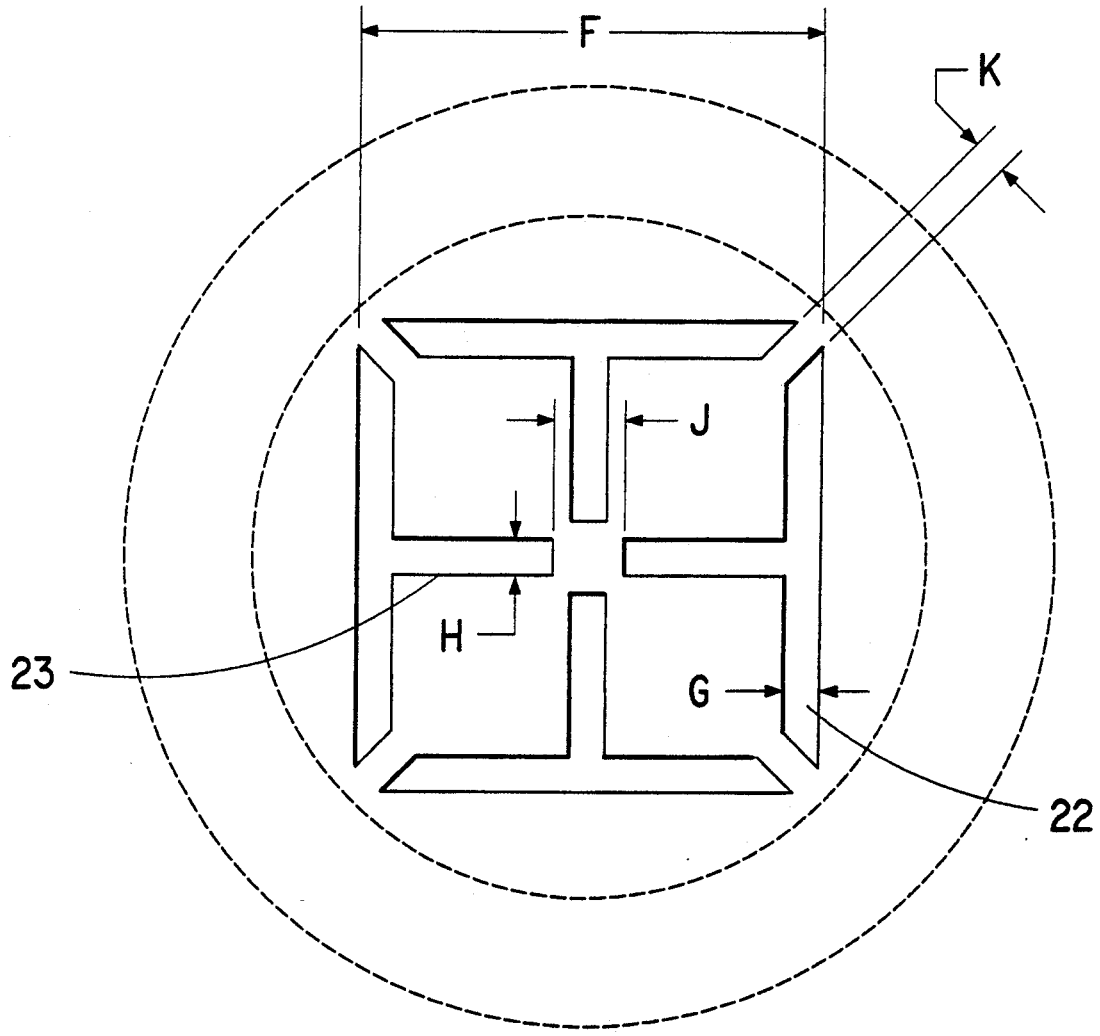
FIG. 1 is a face view of a spinneret capillary for spinning filaments which have voids positioned at the corners of the filament's cross-section.
Figure 1A:
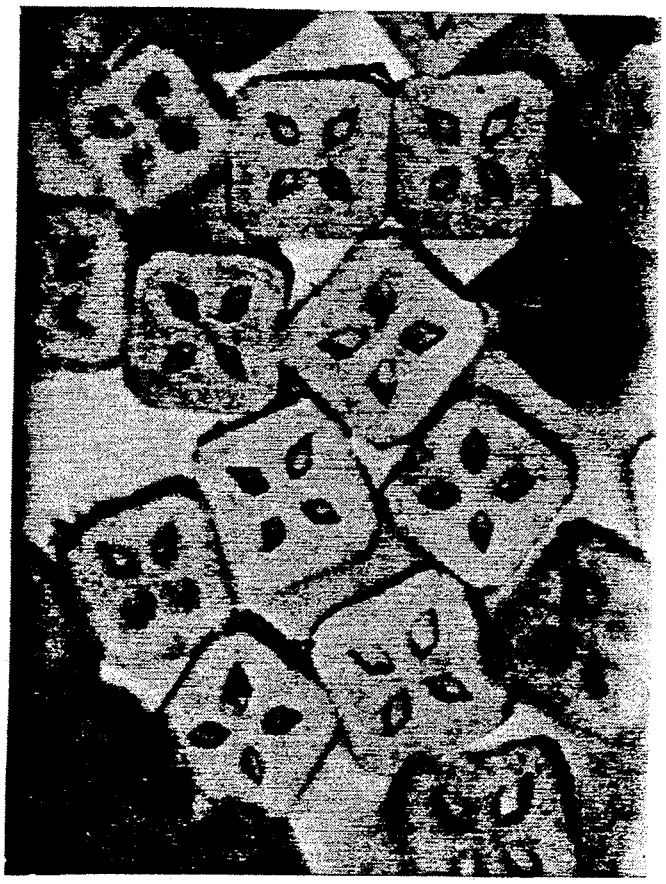

Polypropylene filaments having cross-sections, as shown in FIG. 1-A, were made by the methods described for producing Sample A filaments, except that the melt-spinning dope was spun through a spinneret having the configuration shown in FIG. 1. Referring to FIG. 1, the outside diameter (F) of the spinneret capillary was 0.0791 inches. The width (G) of the peripheral spokes (22) was 0.0087 inches, while the width (H) of the radial spokes (23) was 0.065 inches. The spacing (J) between the ends of the radial spokes was 0.0142 inches, while the spacing (K) between the ends of the peripheral spokes was 0.0060 inches. The depth of the capillary was 0.035 inches, and the length to diameter (L/D) ratio (0.035/0.0065) was about 5.4. The percent void of the filaments was about 12%.

Yarn bundles composed of the above-described polypropylene filaments, Sample A and Comparative Sample B, were then inserted into respectively separate primary backings, and latex was applied. The yarns were inserted as loops to form commercial and residential level loop carpet samples. In the following Tables, those carpets comprising of yarn bundles made from Sample A filaments are identified as Sample A (Commercial) and A-1 (Residential) carpets, and carpets comprising of yarn bundles made from Comparative Sample B filaments are identified as Comparative Sample B (Commercial) and B-1 (Residential) carpets.

Carpet Soiling Performance Test / Commercial Carpets

The yarns comprising the commercial carpet samples had a draw finish at a level of 0.55%. The yarn bundles were single ended, with a base yarn of 2500 denier, and 120 filaments per yarn bundle. The carpet samples had a basis weight of 20 oz./yd$^2$, with a pile height of 0.187 inches. No wet processing was involved in the carpet construction in order to maintain a constant level of finish on the yarns.

The commercial carpet samples (A and B) were tested for carpet soiling performance. Each sample was subjected to 491,000 foot traffics which represents the typical life span of a commercial carpet. Soiling ΔE measurements were taken at different intervals leading up to the 491,000 level. The results of the tests are shown in the following Table I.

TABLE I (ΔE)

| | TRAFFICS | | | | |
|---|---|---|---|---|---|
| SAMPLE | 70M* | 139M | 226M | 296M | 491M |
| A | 7.0 | 9.2 | 9.4 | 9.6 | 9.9 |
| B (COMPARATIVE) | 7.1 | 9.6 | 10.4 | 10.8 | 10.9 |

M* = thousand

Carpet Soiling Performance Test / Residential Carpets

The residential carpet Berber yarns were made by air entangling 6 ends of the above-described 2500 denier commercial yarns. The yarn bundles had a 15,000 denier, with 720 filaments per yarn bundle. The yarns had a draw finish at a level of 0.55%. These heavy denier yarns were tufted on a ¼ gauge level loop machine at 40 oz./yd$^2$. The pile height for the resulting carpets was 0.375 inches. The carpets had a primary backing with latex applied for dimensional stability, and no wet processing occurred during carpet construction, in order to maintain a constant level of finish on the yarns.

The residential carpet samples (A-1 and B-1) were floor tested for 340,000 foot traffics. (Residential applications do not require as many traffics as commercial applications.) The results of the tests are shown in the following Table II.

TABLE II (ΔE)

| | TRAFFICS | | | |
|---|---|---|---|---|
| SAMPLE | 83M* | 115M | 184M | 340M |
| A-1 | 5.3 | 8.0 | 8.9 | 10.0 |
| B-1 (COMPARATIVE) | 7.1 | 8.9 | 10.8 | 12.2 |

M* = thousand

EXAMPLE 2

In this Example, polypropylene filaments were made by the two methods described in Example 1 and yarn bundles having a different base yarn denier were prepared.

Sample C

Polypropylene filaments having cross-sections, as shown in FIG. 2-A, were made by the method described for producing Sample A filaments.

Comparative Sample D

Polypropylene filaments having cross-sections, as shown in FIG. 1-A, were made by the method described for producing Comparative Sample B filaments.

Carpet Soiling Performance Test / Commercial Carpets

Yarn bundles composed of the above-described polypropylene filaments, Sample C and Comparative Sample D, were then inserted into respectively separate primary backings, and latex was applied. The yarns were inserted as loops to form commercial loop carpet samples. In the following Table III, carpets comprising of yarn bundles made from Sample C filaments are identified as Sample C and C-1 carpets, and carpets comprising of yarn bundles made from Comparative Sample D filaments are identified as Comparative Sample D and D-1 carpets. The yarn bundles had a base yarn of 1320 denier, with 70 filaments per bundle. The yarn bundles were made by air entangling either three ends of the base yarn (samples C and D) or four ends of the base yarn (samples C-1 and D-1). The carpet samples had a basis weight of 22 oz./yd$^2$, with a pile height of 0.218 inches, and were tested for 352,000 traffics. The results are shown in Table III.

TABLE III (ΔE)

| | TRAFFIC | |
|---|---|---|
| SAMPLE | 157M* | 352M |
| C (3960 denier) | 11.3 | 12.9 |
| D (3960 denier) | 12.4 | 13.9 |
| C-1 (5280 denier) | 9.1 | 10.5 |
| D-1 (5280 denier) | 10.4 | 11.3 |

M* = thousand

REPRESENTATIVE EXAMPLE 3

The Filament Cross-Section Model was used in this Example. A measurement was taken to determine the soiling performance that a filament's cross-section could offer at different viewing angles. The first measurement was made on the flat surface, referred to as 0° viewing angle. A calculation was made, by dividing the visual distortion width by the total width. The visual distortion width and total width changed with each viewing angle. After the 0° measurement was taken, measurements were taken at 15°, 30° and 45° from the 0° angle. The 45° angle is the corner point of the filament's cross-section. These four angle measurements represented a spectrum of the filament's cross-section which continued to repeat around the surface of the 4 hole squares. The results are listed in Table IV.

TABLE IV

| % SOILING PERFORMANCE VIEWING ANGLE | | | | | |
|---|---|---|---|---|---|
| Viewing Angle | 0° | 15° | 30° | 45° | Overall Efficiency |
| Sample | | | | | |
| E | 57% | 80% | 97% | 94% | 84% |
| F (Comparative) | 38% | 66% | 89% | 98% | 74% |

Sample E—This sample represents the filaments of this invention, wherein each void is substantially centered on a side of the filament's cross-section.

Sample F—This sample represents conventional filaments, wherein the voids are oriented at the corners of the filament's cross-section.

EXAMPLE 4

Figure 4:
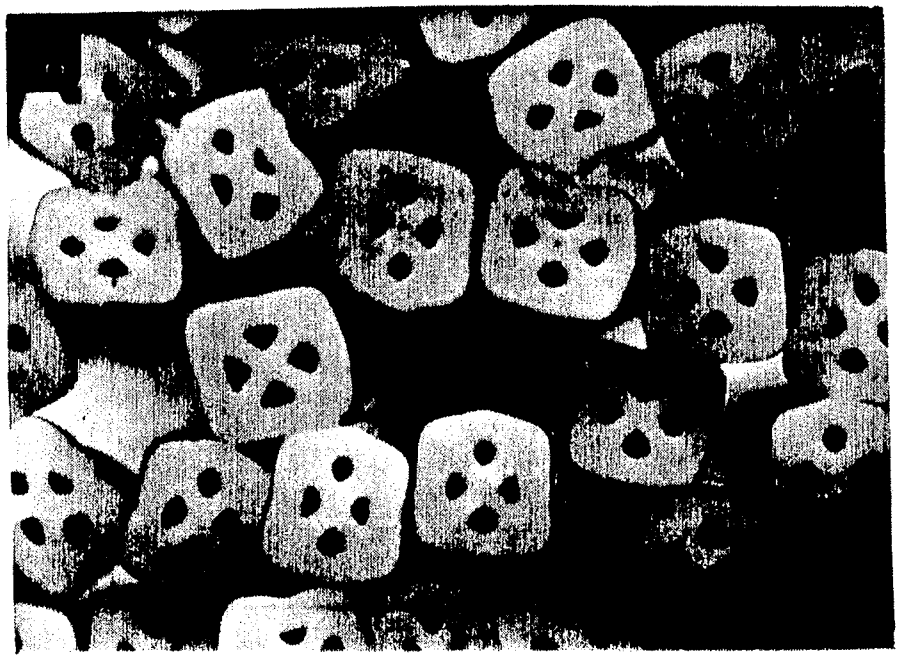
FIG. 4 is a cross-sectional view taken from photomicrographs of nylon 66 filaments spun through capillaries of the type shown in FIG. 2.

In this Example, nylon 66 filaments having cross-sections, similar to those shown in FIG. 4 with the primary difference being rounder shaped voids, were made by the following method.

Nylon 66 polymer (polyhexamethylene adipamide) having a relative viscosity (RV) of about 41 was further polymerized to a higher RV of about 72 by a solid phase polymerization process, melted at 288° C. in a screw melter, and spun at 4.3 grams/hole/minute through a spinneret having the configuration shown in FIG. 2 and into a quench chimney.

The spinneret had the following dimensions. The outside diameter (A) of the spinneret capillary was 0.0791 inches. The width (B) of the peripheral spokes (5) was 0.0080 inches, while the width (C) of the radial spokes (6) was 0.0065 inches. The spacing (D) between the ends of the radial spokes was 0.0100 inches, while the spacing (E) between the ends of the peripheral spokes was 0.0079 inches. The depth of the capillary was 0.035 inches, and he length to diameter (L/D) ratio (0.035/0.0065) was about 5.4.

The quench air-flow rate was about 2.2 ft./sec and the temperature of the air was 10° C. The filaments were treated with aqueous liquid (a mixture of water and non-aqueous draw-finish material), pulled by the feed roll which rotated at 858 ypm and drawn at 2.7 draw ratio by a pair of rolls heated at 205° C. Following drawing, the heated filaments were crimped with a hot air (230° C.), jet-bulking process of the type described in Example 1. The denier per filament was about 19. The percent void of the filaments was about 9%.

Yarn bundles composed of the above-described filaments were prepared. The yarn bundles were two ended with about 860 denier per end and 45 filaments per end (bundle).

EXAMPLE 5

In this Example, nylon filaments having cross-sections, as shown in FIG. 4, were made by the following method.

Nylon 66 polymer (polyhexamethylene adipamide) having a relative viscosity (RV) of about 41 was further polymerized to a higher RV of about 92 by a solid phase polymerization process, melted at 288° C. in a screw melter, and spun at 4.3 grams/hole/minute through a spinneret having the configuration shown in FIG. 2 and into a quench chimney.

The spinneret had the same dimensions of the spinneret in Example 4.

The quench air flow rate was about 2.2 ft/sec and the temperature of the air was 10° C. The filaments were treated with aqueous liquid (a mixture of water and non-aqueous draw-finish material), pulled by the feed roll which rotated at 858 ypm and drawn at 2.7 draw ratio by a pair of rolls heated at 205° C. Following drawing, the heated filaments were crimped with a hot air (230° C.), jet-bulking process of the type described in Example 1. The denier per filament was about 19. The percent void of the filaments was about 11%.

Yarn bundles composed of the above-described filaments were prepared. The yarn bundles were two ended with about 860 denier per end and 45 filaments per end (bundle). The relationship of relative viscosity (RV) to void content of the filaments is shown in Table V.

TABLE V

| RELATIVE VISCOSITY/VOID CONTENT | | |
|---|---|---|
| Example No. | Relative Viscosity (RV) | Percent Void |
| 4 | 72 | 8.6% |
| 5 | 92 | 11.1% |

EXAMPLE 6

Figure 5:
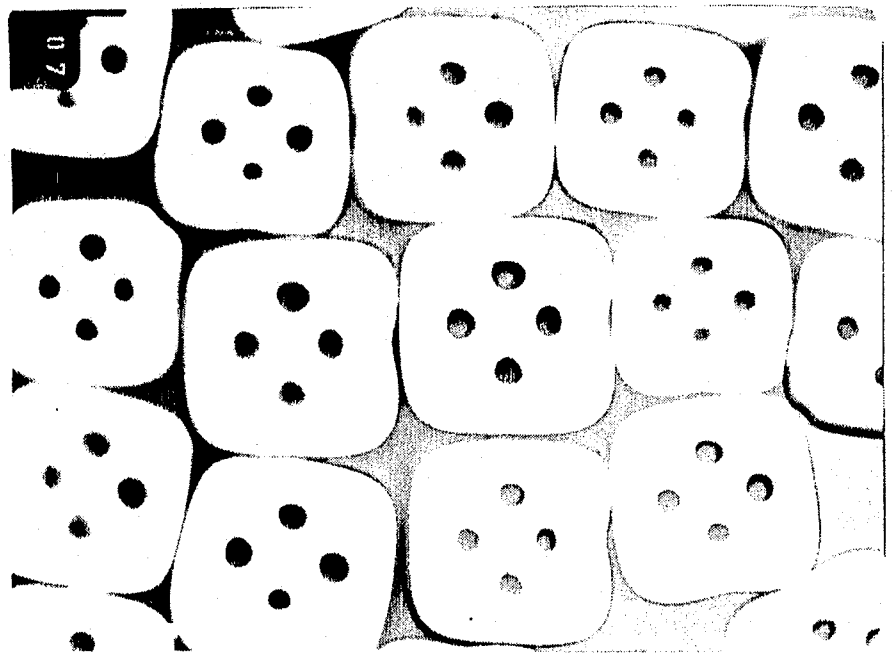
FIG. 5 is a cross-sectional view taken from photomicrographs of polyester filaments spun through capillaries of the type shown in FIG. 2, wherein the outside diameter of the capillaries is 0.0791 inches.

In this Example, polyester filaments having cross-sections, as shown in FIG. 5, were made by the following method.

Polyethylene terephthalate polymer, with a relative viscosity measured in hexafluoroisopropanol (HRV) of 24, was melted at 281° C. in a screw melter, fed through a filter pack, and spun through a spinneret having the configuration shown in FIG. 2 at a rate of 3.0 grams per minute per hole.

The spinneret had the same dimensions of the spinneret in Example 4. The outside diameter of the spinneret capillary was 0.0791 inches. The width of the peripheral spokes was 0.0080 inches, while the width of the radial spokes was 0.0065 inches. The spacing between the ends of the radial spokes was 0.0100 inches, while the spacing between the ends of the peripheral spokes was 0.0079 inches. The depth of the capillary was 0.035 inches, and the length to diameter (L/D) ratio (0.035/0.0065) was about 5.4.

There were 6 filaments per end. The extruded filaments passed through a chamber where they were cross-flow quenched with room temperature air and treated with aqueous liquid (a mixture of water and non-aqueous draw-finish material). The yarn was pulled at a feed roll speed of 560 ypm and drawn at 2.5× draw ratio. The denier per filament was about 21. The percent void of the filaments was about 6%. Yarn bundles composed of the above-described filaments were prepared.

EXAMPLE 7

Figure 6:
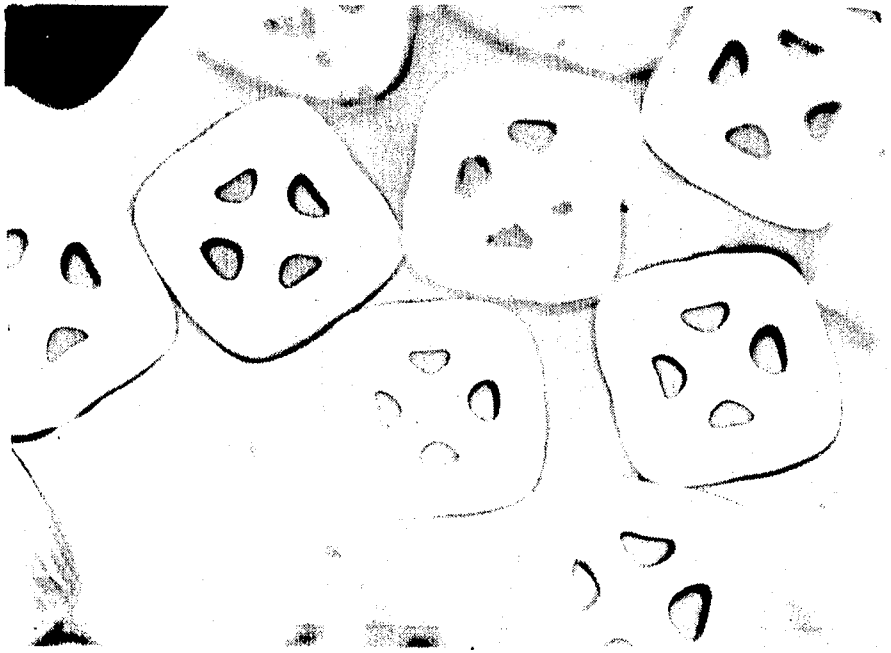
FIG. 6 is a cross-sectional view taken from photomicrographs of polyester filaments spun through capillaries of the type shown in FIG. 2, wherein the outside diameter of the capillaries is 0.0120 inches.

In this Example, polyester filaments having cross-sections, as shown in FIG. 6, were made by the following method.

Polyethylene terephthalate polymer, with a relative viscosity measured in hexafluoroisopropanol (HRV) of 24, was melted at 281° C. in a screw melter, fed through a filter pack, and spun through a spinneret having the configuration shown in FIG. 2 at a rate of 3.0 grams per minute per hole.

The spinneret had the same dimensions of the spinneret in Example 6, except for the outside diameter. The outside diameter of the spinneret capillary was 0.0120 inches.

There were 6 filaments per end. The extruded filaments passes through a chamber, where they were cross-flow quenched with room temperature air and treated with aqueous liquid (a mixture of water and non-aqueous draw-finish material). The yarn was pulled at a feed roll speed of 560 ypm and drawn at 2.5× draw ratio. The denier per filament was about 21. The percent void of the filaments was about 9%. Yarn bundles composed of the above-described filaments were prepared.

We claim:

1. A carpet yarn, comprising continuous filaments, said filament comprising a thermoplastic synthetic polymer and having a solid axial core and four substantially equispaced continuous nonround voids, a void content of about 6% to 25%, and a four sided cross-sectional contour which is free of substantial convex or concave curves, wherein each void is substantially centered on a side of the contour.

2. A carpet, comprising the yarn of claim 1.

3. A carpet yarn, comprising continuous filaments, said filament comprising a thermoplastic synthetic polymer and having a solid axial core and four substantially equispaced continuous round voids, a void content of about 6% to 25%, and a four sided cross-sectional contour which is free of substantial convex or concave curves, wherein each void is substantially centered on a side of the contour.

4. A carpet, comprising the yarn of claim 3.

5. A carpet yarn, comprising continuous filaments, said filament comprising a thermoplastic synthetic polymer and having a solid axial core and four substantially equispaced continuous triangular-like voids, a void content of about 6% to 25%, and a four sided cross-sectional contour which is free of substantial convex or concave curves, wherein the apex of each void is directed at the central longitudinal axis of the core, and the base of each void is substantially centered on a side of the contour.

6. A carpet, comprising the yarn of claim 5.

* * * * *